US005781094A

United States Patent [19]

Nakamura et al.

[11] Patent Number: 5,781,094

[45] Date of Patent: Jul. 14, 1998

[54] SECONDARY SHORT PREVENTING MECHANISM OF FUSE

[75] Inventors: Goro Nakamura; Kenji Muramatsu, both of Shizuoka, Japan

[73] Assignee: Yazaki Corporation, Tokyo, Japan

[21] Appl. No.: 754,139

[22] Filed: Nov. 22, 1996

[30] Foreign Application Priority Data

Nov. 24, 1995 [JP] Japan ..... 7-305869

[51] Int. Cl.[6] ..... H01H 85/36

[52] U.S. Cl. ..... 337/238; 337/239; 337/261; 337/295

[58] Field of Search ..... 337/186, 159, 337/197, 238, 239, 261, 295, 240, 260, 219, 198, 142, 190, 195, 401, 405, 407, 414, 415; 439/621, 622

[56] References Cited

U.S. PATENT DOCUMENTS 4,871,990 10/1989 Ikeda et al. ..... 337/238
5,186,664 2/1993 Abe ..... 439/845

FOREIGN PATENT DOCUMENTS 64-33146 3/1989 Japan ..... H01H 85/00

*Primary Examiner*—Leo P. Picard
*Assistant Examiner*—Anatoly Vortman
*Attorney, Agent, or Firm*—Sughrue, Mion, Zinn, Macpeak & Seas, PLLC

[57] ABSTRACT

A secondary short preventing mechanism of a fuse is constituted by a pair of female terminal members in which male terminal receiving portions are formed at their longitudinally one ends respectively so that the male terminal receiving portions are to be engaged with and electrically connected to male terminal portions, and a fuse fusing portion is formed between their longitudinally other ends; and a housing for housing the female terminal portions, the housing having a vertically extending insulation partition for horizontally separating the male terminal receiving portions from each other in a loosely fitted state. Each of the male terminal receiving portions has raised pressing contact portions which oppose to each other at different levels, that is, at upper and lower positions in their longitudinal directions, the upper pressing contact portion being directed toward the insulation partition, and at least one of the pressing contact portions having elasticity.

4 Claims, 3 Drawing Sheets

SECONDARY SHORT PREVENTING MECHANISM OF FUSE

BACKGROUND OF THE INVENTION

The present invention relates to a secondary short preventing mechanism of a fuse to be used in an electric circuit of a vehicle or the like, and particularly relates to a secondary short preventing mechanism of a fuse which is improved to prevent the occurrence of secondary short of the fuse caused by mutual contact between holding portions for holding a fusing portion after the fusing portion has been fused.

Referring to FIGS. 4, 5 and 6, the schematic configuration of an ordinary fuse to be applied to a connector for connecting a wire harness of a vehicle or the like will be described. A fuse 50 is constituted by a fusible link 51 which is formed in a predetermined shape, and an insulation housing 61 in which the fusible link 51 is incorporated and which is to be removably attached onto a high density multielectrode connector (not shown) so as to make terminal connection possible.

The fuse member 51 has a pair of female terminal portions 52 and 52 facing to each other. Lock portions 53 are cut up in the female terminal portions 52 at their not-opposing surface sides. Holding portions 54 having relatively narrow widths and extending upward from the not-opposing surface sides respectively are bent so as to be connected to each other, and a fusing portion 55 which has a width set narrow correspondingly to a permissible fusing capacity is formed on an intermediate portion of the connection portion.

In order to receive the female terminal portions 52, the housing 61 is partitioned by an insulation partition 64 so as to form a pair of terminal receiving portions 62 and 62 and lock ditches 65 for locking lock portions 53 respectively, at lower-half portion of a space defined by a pair of inner wall surfaces opposing each other. Each of the terminal receiving portions 62 has a male terminal insertion opening 63.

Further, a pair of guide ditches 67 and 67 each formed by a projected end portion formed with a sloping surface 67*a* so as to guide the lock portion 53 in a fusing chamber 66 are formed in the upper-half portion side defined by the inner wall surfaces, and a cover member 68 is fitted on an upper opening.

Incorporation of the fusible link 51 into the housing 61 is performed such that the lock portions 53 of the fusible link 51 are pushed, from the upper opening side of the housing 61, along the guide ditches 67 by using a suitable insertion jig or the like so that the fusible link 51 is incorporated into the housing 61. That is, by the thus pushing-in operation, the pair of female terminal portions 52 and 52 are disposed in the corresponding terminal receiving portions 62 with correct postures.

Next, the lock portions 53 are urged and energized inward by the sloping surfaces 67*a* respectively with advance of the insertion operation. Thereafter, at the time where the respective female terminal portions 52 have been received in the terminal receiving portions 62, the respective lock portions 53 are recovered from the urged state, and locked in the lock ditches 65 respectively, so that the incorporation is completed.

In the thus configured fuse 50, the respective female terminal portions 52 are fitted, through the insertion openings 63, onto male terminal portions projected in an attachment portion of a high density multielectrode connector (not shown). When an electric current exceeding an allowable value flows in an associated circuit in this state of use, the fusing portion 55 is fused by Joule heat to thereby open the circuit so as to secure the safety of the circuit.

In the case of the foregoing conventional fuse 50, however, there is such a possibility that when the fuse 50 is used in a place such as a vehicle or the like where extremely violent vibrations, shocks, or the like are generated, the support portions 54 which have not been supported because of fusing of the fusing portion 55 are mutually inclined inside due to the vibrations, shocks, or the like after the fusing portion 55 has been fused as shown in FIG. 6, and the support portions 54 come into contact with each other again in a gap between a and b in FIG. 6. Therefore, the support portions 54 come into contact with each other to thereby generate a secondary short accident.

In order to prevent the occurrence of such a secondary short accident, there has been proposed such a fuse as disclosed, for example, in Japanese Utility Model. Unexamined Publication No. Sho. 64-33146. However, in the secondary short preventing structure with respective to this fuse, the configuration is relatively complicated and there are problems in reliability and in cost.

SUMMARY OF THE INVENTION

An object of the present invention is to solve the foregoing conventional problems and to provide a secondary short preventing mechanism of a fuse in which occurrence of a secondary short accident due to mutual contact of holding portions after fusing of a fusing portion can be prevented with a simple structure.

The aforementioned object of the present invention is attained by a secondary short preventing mechanism of a fuse characterized by comprising: a pair of female terminal portions in which male terminal receiving portions are formed at their longitudinally one ends respectively so that said male terminal receiving portions are to be engaged with and electrically connected to male terminal portions, and a fuse fusing portion is formed at their longitudinally other ends by connecting said longitudinally other ends through a fusible conductor; a housing for housing said female terminal portions, said housing having a vertically extending insulation partition for horizontally separating said male terminal receiving portions from each other in a loosely fitted state; each of said male terminal receiving portions having raised pressing contact portions which oppose to each other at different levels, that is, at upper and lower positions in their longitudinal directions, the upper pressing contact portion being directed toward said insulation partitions, at least one of said pressing contact portions having elasticity.

In the secondary short preventing mechanism of a fuse according to the present invention, a male terminal is inserted into the male terminal receiving portion of the housing so as not to rotate and is further inserted in the longitudinal direction thereof between the elastic pressing contact portions which are raised in the male terminal receiving portion so as to oppose to each other at two, upper and lower, positions so that the male terminal is supported at two different levels from the left side and right side by the two raised portions. The male terminal receiving portion is housed in the housing parallelly to the insulation partition while the upper portion of the male terminal receiving portion is given a force by the raised portions constituting the elastic pressing contact portions so as to rotate outside of the housing. When the fuse fusing portion is fused-off by an overcurrent, a balance between the male terminal receiving portions is lost so that the upper portions of the male terminal receiving portions are rotated outward by the rotating force to the outside of the housing. As a result, the interval between the fused ends is widened so that it is possible to prevent such a risk that, upon reception of vibrations or the like, the fused ends come into contact with each other again to generate secondary short.

In a preferred embodiment according to the present invention, an upper pressing contact portion is constituted by an elastic projection and a lower pressing contact portion is constituted by a projection formed by an elastic spring member. Therefore, the rotary force of the female terminal portions at the time of fusing-off of a fuse increases and further insertion of the male terminal portion is more easily performed.

In another preferred embodiment according to the present invention, an upper pressing contact portion is constituted by a both-side-supported spring, and a lower pressing contact portion is constituted by a cantilever spring having a lower portion fixed to the male terminal receiving portion, so that, in addition to the effect of the above-mentioned preferable embodiment, the male terminal can be easily inserted with a small pressing force because the upper end of the lower pressing contact portion extends longitudinally so as to be transformable, and the rotation of the female terminal portions after fusing-off becomes flexible to thereby make it possible to reduce a reaction due to the fusing-off because the elastic biasing force of the female terminal portion is reduced at that time.

The width of a lower portion of the insulation partition of the housing is formed to be narrower than that of an upper portion of the same so as to secure a space where the male terminal receiving portions can be rotated at the time of fusing-off of the fuse fusing portion. As a result, when the male terminal receiving portions rotate toward the outside, the lower portions of the male terminal receiving portions rotate easily toward the inside so that the effect of the mechanism according to the present invention is further increased.

DETAILED DESCRIPTION OF THE INVENTION

Figure 1:
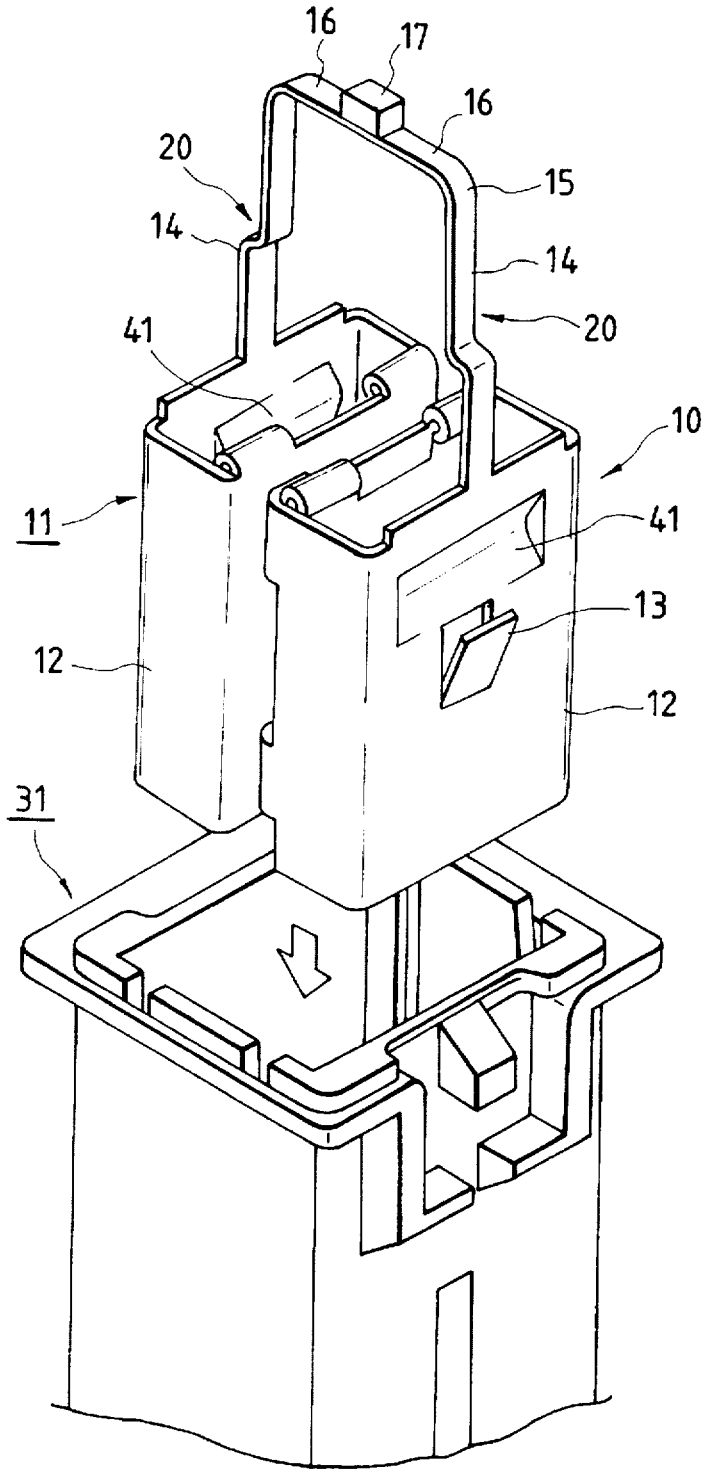
FIG. 1 is a perspective view showing the schematic configuration of a fuse which is an embodiment of the secondary short preventing mechanism of a fuse according to the present invention.
Figure 2:
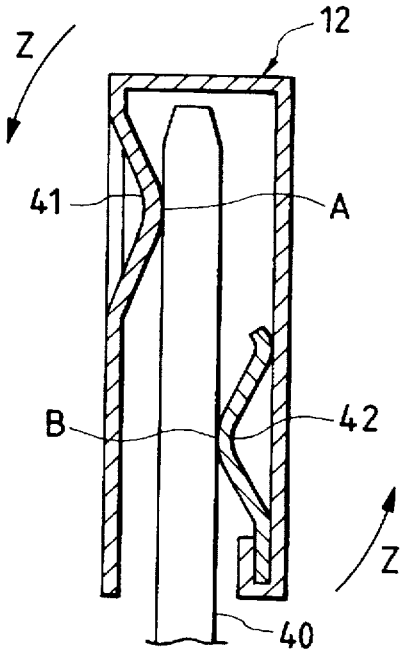
FIG. 2 is an enlarged sectional view showing a part of a male terminal receiving portion of one female terminal portion.
Figure 3:
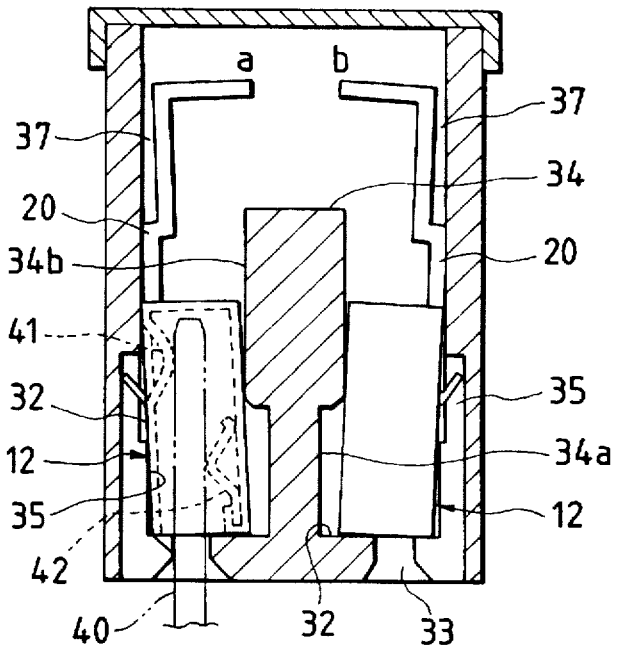
FIG. 3 is a vertically sectional view showing a state where a fusible link is incorporated in a housing in the embodiment of FIG. 1.
Figure 4:
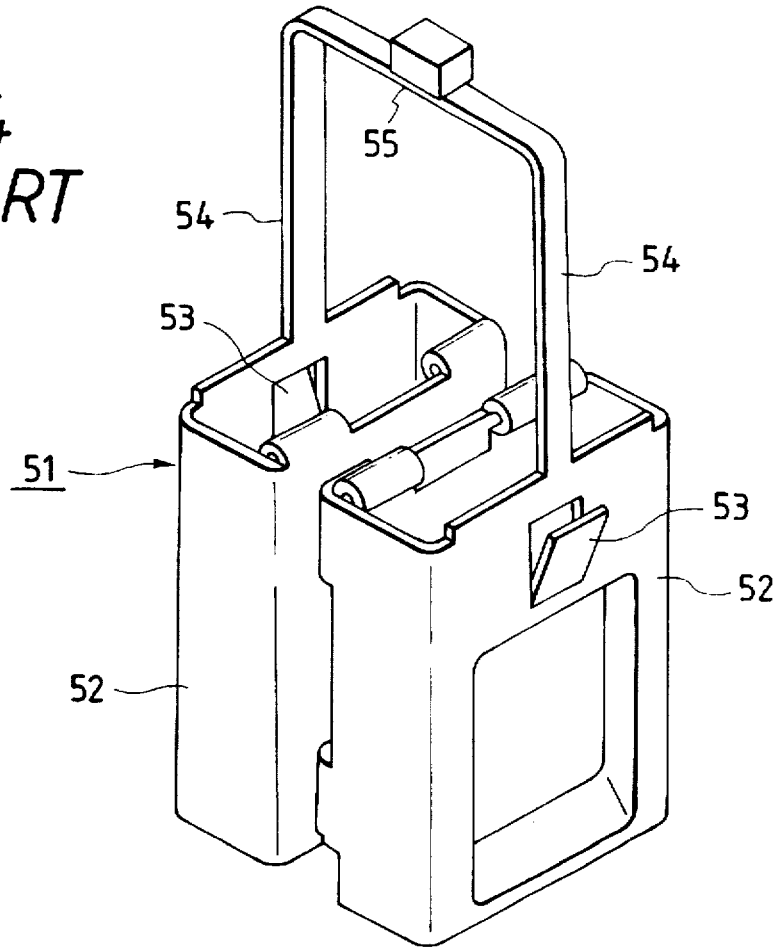
FIG. 4 PRIOR ART
FIG. 4 is a perspective view showing a conventional fusible link.
Figure 5:
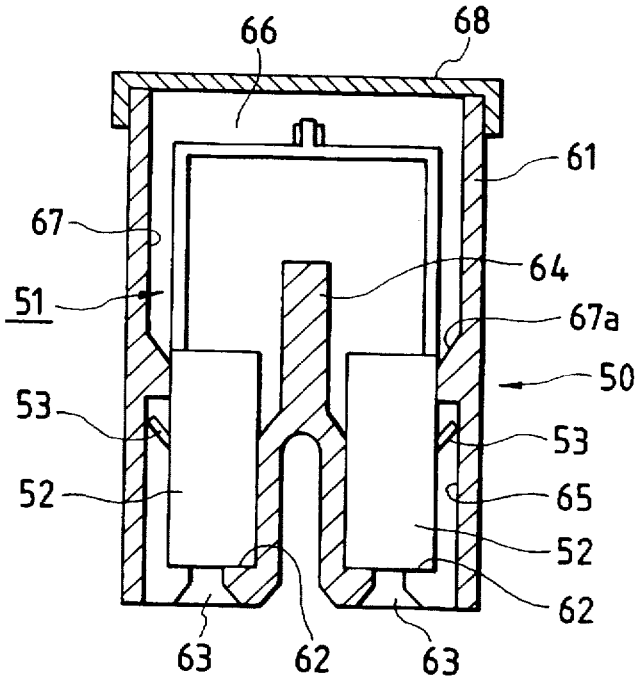
FIG. 5 PRIOR ART
FIG. 5 is a schematic vertically sectional view showing a state where the conventional fusible link of FIG. 4 is incorporated in a housing.
Figure 6:
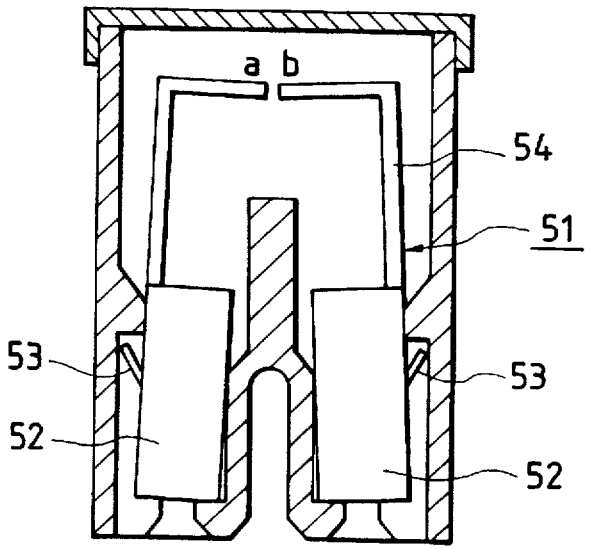
FIG. 6 PRIOR ART
FIG. 6 is a schematic vertically sectional view showing a state where a fusing portion is fused in FIG. 4.

Referring to FIGS. 1, 2 and 3, an embodiment of the secondary short preventing mechanism of a fuse according to the present invention will be described. FIG. 1 is a perspective view showing the schematic configuration of a fuse to which the secondary short preventing mechanism according to this embodiment is applied, FIG. 2 is a vertically sectional view showing a male terminal receiving portion constituting the secondary short preventing mechanism, and FIG. 3 is a vertical sectional view showing the fuse of FIG. 1 in the assembled state.

As shown in FIGS. 1 to 3, a fuse 10 according to this embodiment is constituted by a fusible link 11 formed into a predetermined shape, and a housing 31 made of an electrical insulation material such as a plastic substance in which the fusible link 11 is incorporated and which is removably attached to a high density multielectrode connector (only a part of one terminal pin is shown in FIGS. 2 and 3) so that terminal connection can be performed.

The fusible link 11 has a pair of female terminal members 20 and 20 opposing to each other, and lock portions 13 are cut up in male terminal receiving portions 12 at their not-opposing surface sides.

Further, there is provided holding portions 14 extending upward from the not-opposing surface sides of the respective male terminal receiving portions 12. Each of the holding portions 14 is constituted by an upper bent portion 15 bent inward and a top portion 16 extending from the bent portion 15. A gap between the top portions 16 and 16 of the respective holding portions 14 is set to a narrow width corresponding to a fusing capacity and the top portions 16 and 16 are connected to each other through a fusing portion 17 having a tin chip.

A housing 31 is formed into a rectangular pillar and is partitioned by a vertical insulation partition 34 extending to an upper half portion side of a pair of inner wall surfaces opposing to each other in the housing 31 so as to secure a pair of terminal receiving portions 32 which are separated from each other so as to receive the male terminal receiving portions 12 at the lower half portion side of the pair of inner wall surfaces. Further, as shown in FIG. 3, in each of the pair of terminal receiving portions 32, an insertion opening 33 for inserting a male terminal 40 is formed in a bottom portion and a lock ditch 35 extending upward from the lower bottom surface is formed so as to make the lock portion 13 locked to a housing inner wall.

In use, as shown in FIG. 2, the male terminal 40 is inserted from the lower end insertion opening 33, firmly fixed on the housing 31 by means of an attachment tool (not shown) such as a socket or a bush, and inserted into the inside of the male terminal receiving portion 12. The male terminal is supported by pressing contact portions 41 and 42 which are raised in opposition to each other at upper and lower positions within the male terminal receiving portion. A central portion of the pressing contact portion 41 located at the upper portion rises toward the insulation partition 34 extending vertically up. The pressing contact portion 41 is constituted by a both-side-support plate integrally pressed out with a part of the male terminal receiving portion, and, on the other hand, contacts with the surface portion of the male terminal 40 to which it opposes diametrically.

Although it is preferable that the pressing contact portion 41 located at the upper portion has elasticity, when taking the frictional resistance against insertion of the male terminal into consideration, it is not always particularly necessary to make the pressing contact portion 41 have elasticity because it is sufficient if the pressing contact portion 41 can act as a pivotal fulcrum with respect to the male terminal in operation.

The other pressing contact portion 42 provided below the pressing contact portion 41 is constituted by, for example, a cantilever plate spring member having a raised portion and being fixed at its lower end portion on the lower end of the male terminal receiving portion. In this configuration, when the fusing portion 17 is fused, the both-end-supported elastic pressing contact portion 41 and the cantilever spring member 42 immediately output force so as to rotate the male terminal receiving portion 12 in the direction Z in FIG. 2, that is, so as to rotate the upper end of the male terminal receiving portion 12 outward in the housing 31, with a point A as a fulcrum and a point B as a point of application where force is applied.

Upon reception of the foregoing rotary force, the lower end of the male terminal receiving portion 12 moves toward the insulation partition 34 of the housing 31. In order to accept the movement, a lower end 34*a* of the insulation partition 34 is formed to have a diameter smaller than that of an upper end 34*b* so as to secure a space where the lower end of the female terminal member 20 is slightly rotated. Therefore, as viewed from the whole fusible link 11, the rotational movements that both the female terminal members rotate separately in the directions opposite to each other are generated at the same time when the fusing portion is fused. The female terminal members stop in the opened state so that such a fear that the top ends a and b of the right and left holding portions 14 come into contact with each other is not generated, and as a result secondary short can be prevented from occurring.

In this embodiment, when the fusible link 11 is to be incorporated into the housing 31, the lock portions 13 of the fusible link 11 are inserted from an upper opening side of the housing 31 along guide ditches 37 (FIG. 3) by using a suitable insertion jig or the like. Thereafter, at the time when the male terminal receiving portions 12 have been received in the terminal receiving portions 32 respectively, the lock ditches portions 13 are recovered from the urged state and locked in the lock ditches 35 respectively. The lock portions 13 prevent the fusible link 11 from being pushed-off upward when the male terminal 40 is inserted into the female terminal 20.

Next, the inter-terminal connection using the fuse 10 according to this embodiment will be briefly described. In use, the male terminal receiving portions 12 are connected to the male terminals projected in an attachment portion of a high density multielectrode connector (not shown) through the insertion openings 33. When an electric current exceeding an allowable value flows in the associated electric circuit in the state of use, the fusing portion 17 is fused by Joule heat to open the circuit so as to secure the safety of the circuit.

As described above, according to the present invention, there is obtained such an effect that the upper ends of the male terminal receiving portions rotate outward to separate the holding portions from each other after the fusing portion is fused so that a secondary short accident due to mutual contact of the fuse holding portions can be surely prevented from occurring with a simple structure without providing any special separating means.

What is claimed is:

1. A secondary short preventing mechanism of a fuse, comprising:

a pair of female terminal portions including male terminal receiving portions at one ends of said female terminal portions respectively in a longitudinal direction, said male terminal receiving portions being to be engaged with and electrically connected to male terminal portions respectively, and a fuse fusing portion at the other ends of said female terminal portions in the longitudinal direction, said fuse fusing portion having a fusible conductor connecting said other ends to each other; and a housing for housing said female terminal portions, said housing including a vertically extending insulation partition for horizontally separating said male terminal receiving portions from each other in a loosely fitted state;

wherein each of said male terminal receiving portions includes an upper raised pressing contact portion and a lower raised pressing contact portion which oppose to each other at different levels of upper and lower positions in the longitudinal direction, said upper raised pressing contact portion is directed toward said insulation partition, and at least one of said raised upper and lower pressing contact portions has elasticity.

2. A secondary short preventing mechanism of a fuse according to claim 1, wherein said upper pressing contact portion is an elastic projection and said lower pressing contact portion is a projection constituted by an elastic spring member.

3. A secondary short preventing mechanism of a fuse according to claim 2, wherein said upper pressing contact portion is a both-side-supported spring and said lower pressing contact portion is a cantilever spring having a lower end portion fixed to said male terminal receiving portion.

4. A secondary short preventing mechanism of a fuse according to claim 1, wherein a width of a lower portion of said insulation partition of said housing is formed to be narrower than that of an upper portion of said insulation partition so as to secure a space so that said male terminal receiving portions can be rotated at the time of fusing-off of said fuse fusing portion.

* * * * *